US010501966B2

(12) United States Patent
Nagata et al.

(10) Patent No.: US 10,501,966 B2
(45) Date of Patent: Dec. 10, 2019

(54) VEHICLE DOOR HANDLE

(71) Applicant: AISIN SEIKI KABUSHIKI KAISHA, Kariya-shi, Aichi (JP)

(72) Inventors: Koichi Nagata, Chiryu (JP); Nobukazu Araki, Hekinan (JP); Seiji Shimada, Nagoya (JP); Eiji Mushiake, Aichi-ken (JP); Masayuki Kawano, Kariya (JP)

(73) Assignee: AISIN SEIKI KABUSHIKI KAISHA, Kariya-Shi, Aichi-Ken (JP)

( * ) Notice: Subject to any disclaimer, the term of this patent is extended or adjusted under 35 U.S.C. 154(b) by 476 days.

(21) Appl. No.: 14/900,424

(22) PCT Filed: Jun. 18, 2014

(86) PCT No.: PCT/JP2014/066147

§ 371 (c)(1),
(2) Date: Dec. 21, 2015

(87) PCT Pub. No.: WO2014/203927

PCT Pub. Date: Dec. 24, 2014

(65) Prior Publication Data

US 2016/0138304 A1 May 19, 2016

(30) Foreign Application Priority Data

Jun. 21, 2013 (JP) ..... 2013-130104

(51) Int. Cl.
*E05B 79/22* (2014.01)
*E05B 81/78* (2014.01)
(Continued)

(52) U.S. Cl.
CPC ..... *E05B 79/22* (2013.01); *E05B 79/06* (2013.01); *E05B 81/04* (2013.01); *E05B 81/56* (2013.01);
(Continued)

(58) Field of Classification Search
CPC ..... E05B 77/34; E05B 79/06; E05B 79/22; E05B 81/76; E05B 81/77; E05B 81/78;
(Continued)

(56) References Cited

U.S. PATENT DOCUMENTS 6,740,834 B2 * 5/2004 Sueyoshi ..... B60R 25/246 200/293.1
7,057,124 B2 * 6/2006 Ieda ..... E05B 81/76 200/520
(Continued)

FOREIGN PATENT DOCUMENTS

DE 102013105788 A1 * 12/2014 ..... E05B 81/76
EP 1067257 A1 * 1/2001 ..... E05B 85/16
(Continued)

OTHER PUBLICATIONS

*International Search Report (PCT/ISA/210) dated Aug. 12, 2014, by the Japanese Patent Office as the International Searching Authority for International Application No. PCT/JP2014/066147.
(Continued)

*Primary Examiner* — Christine M Mills
(74) *Attorney, Agent, or Firm* — Buchanan Ingersoll & Rooney PC

(57) ABSTRACT

A door handle for a vehicle includes a handle inner member made of a resin, which is arranged on a vehicle inner side, a handle outer member, which is assembled to a vehicle outer side of the handle inner member to form an accommodating portion between the handle outer member and the handle inner member, and a connector provided to the handle inner member. The connector includes a resin connector main body independent of the handle inner member and coupled integrally with the handle inner member. In the connector main body, connector terminals and an electronic component are connected in a component accommodating recessed portion formed on one side thereof and is commu-
(Continued)

nicated with the accommodating portion. A connection portion between the connector terminals and the electronic component is protected by potting material filled in the component accommodating recessed portion.

5 Claims, 7 Drawing Sheets

(51) Int. Cl.

| | |
|---|---|
| ***E05B 85/16*** | (2014.01) |
| ***E05B 81/04*** | (2014.01) |
| ***E05B 81/56*** | (2014.01) |
| ***E05B 81/76*** | (2014.01) |
| ***E05B 85/14*** | (2014.01) |
| ***E05B 79/06*** | (2014.01) |
| *E05B 77/34* | (2014.01) |

(52) U.S. Cl.
CPC ..... *E05B 81/76* (2013.01); *E05B 81/78* (2013.01); *E05B 85/14* (2013.01); *E05B 85/16* (2013.01); *E05B 77/34* (2013.01)

(58) Field of Classification Search
CPC ..... E05B 81/04; E05B 81/56; E05B 85/10; E05B 85/14; E05B 85/16; Y10T 292/57; Y10S 292/38; Y10S 292/53; Y10S 292/54; Y10S 292/64
USPC ..... 292/336.3, DIG. 38, DIG. 53, DIG. 54, 292/DIG. 64; 340/5.62, 5.72
See application file for complete search history.

(56) References Cited

U.S. PATENT DOCUMENTS

| | | | | |
|---|---|---|---|---|
| 7,270,452 | B2 * | 9/2007 | Wang | B60Q 1/2669 362/501 |
| 7,333,021 | B2 * | 2/2008 | Ieda | B60Q 1/2669 340/425.5 |
| 7,598,915 | B2 * | 10/2009 | Ieda | B60R 25/246 343/713 |
| 7,600,795 | B2 * | 10/2009 | Cummins | E05B 47/004 292/336.3 |
| 7,819,442 | B2 * | 10/2010 | Ieda | B60R 25/24 292/336.3 |
| 7,866,860 | B2 * | 1/2011 | Goto | E05B 17/10 362/501 |
| 8,042,845 | B2 * | 10/2011 | Tanimoto | E05B 81/78 292/336.3 |
| 8,333,492 | B2 * | 12/2012 | Dingman | B60Q 1/2665 362/399 |
| 8,576,047 | B2 * | 11/2013 | Peschl | E05B 81/76 180/271 |
| 8,601,903 | B1 * | 12/2013 | Klein | E05B 81/78 16/110.1 |
| 8,801,245 | B2 * | 8/2014 | De Wind | B60Q 1/2619 362/511 |
| 2005/0077737 | A1 * | 4/2005 | Komiyama | E05B 81/78 292/336.3 |
| 2005/0236846 | A1 * | 10/2005 | Hidaka | H03K 17/962 292/216 |
| 2007/0091627 | A1 | 4/2007 | Nitawaki et al. | |
| 2007/0216175 | A1 | 9/2007 | Tanimoto et al. | |
| 2010/0019510 | A1 * | 1/2010 | Ieda | E05B 81/78 292/173 |
| 2010/0088856 | A1 * | 4/2010 | Mueller | E05B 81/78 16/421 |
| 2010/0187838 | A1 * | 7/2010 | Ieda | B60R 25/00 292/336.3 |
| 2010/0205780 | A1 * | 8/2010 | Ieda | B60R 25/00 16/412 |
| 2012/0019014 | A1 * | 1/2012 | Tateishi | E05B 81/78 292/336.3 |
| 2012/0127746 | A1 * | 5/2012 | Lee | B60Q 1/2669 362/501 |
| 2012/0133159 | A1 * | 5/2012 | Tateishi | E05B 81/77 292/336.3 |
| 2013/0130674 | A1 * | 5/2013 | De Wind | B60Q 1/2619 455/420 |
| 2014/0125072 | A1 * | 5/2014 | Nagata | E05B 85/16 292/336.3 |
| 2014/0310916 | A1 * | 10/2014 | Shimizu | E05B 81/76 16/412 |
| 2016/0160539 | A1 * | 6/2016 | Saitou | E05B 85/16 292/336.3 |
| 2016/0193957 | A1 * | 7/2016 | De Wind | B60Q 1/2619 362/23.12 |
| 2016/0230429 | A1 * | 8/2016 | Witte | E05B 81/64 |
| 2017/0246986 | A1 * | 8/2017 | Imai | B60Q 1/2669 |
| 2017/0250464 | A1 * | 8/2017 | Kawano | H01Q 1/3283 |
| 2017/0298660 | A1 * | 10/2017 | Nagata | E05B 79/04 |

FOREIGN PATENT DOCUMENTS

| | | | | |
|---|---|---|---|---|
| EP | 1284335 | A1 * | 2/2003 | E05B 81/76 |
| EP | 2811091 | A2 * | 12/2014 | E05B 81/76 |
| FR | 2819538 | A1 * | 7/2002 | E05B 81/76 |
| JP | 2005-009216 | A | 1/2005 | |
| JP | 2005-82090 | A | 3/2005 | |
| JP | 2007-247268 | A | 9/2007 | |
| JP | 2007-254995 | A | 10/2007 | |
| JP | 2010043524 | A * | 2/2010 | E05B 17/10 |
| JP | 2014211066 | A * | 11/2014 | E05B 81/76 |
| JP | 2015025261 | A * | 2/2015 | E05B 85/16 |
| WO | WO 2009/017048 | A1 | 2/2009 | |

OTHER PUBLICATIONS

*Written Opinion (PCT/ISA/237) dated Aug. 12, 2014, by the Japanese Patent Office as the International Searching Authority for International Application No. PCT/JP2014/066147.
The extended European Search Report dated Jun. 22, 2016, by the European Patent Office in corresponding European Application No. 14814584.0. (8 pages).

* cited by examiner

VEHICLE DOOR HANDLE

TECHNICAL FIELD

The present invention relates to a door handle for a vehicle, and more particularly, to a door handle for a vehicle, including a handle inner member made of a resin that is arranged on a vehicle inner side, a handle outer member assembled to a vehicle outer side of the handle inner member, for forming an accommodating portion between the handle outer member and the handle inner member, and a connector provided to the handle inner member.

BACKGROUND ART

The above-mentioned type of door handle for a vehicle is described in, for example, JP 2007-254995 A. In JP 2007-254995 A, there are described an embodiment including a connector main body of the connector, which is made of a resin and formed integrally with the handle inner member, and an embodiment including a connector main body of the connector, which is made of a resin, formed as a member independent of the handle inner member, and coupled integrally with the handle inner member.

SUMMARY OF INVENTION

In each of the embodiments of the door handle for a vehicle described in JP 2007-254995 A, a component accommodating recessed portion for accommodating accommodating-portion-side end portions of connector terminals of the connector and an electronic component (for example, a substrate) to be connected the end portions are formed by the connector main body and the handle inner member. Therefore, in a case where a connection portion between the connector terminals and the electronic component that are accommodated in the above-mentioned component accommodating recessed portion is protected by a potting material (silicone-based embedding resin) filled in the component accommodating recessed portion, the potting material adheres to two components, that is, the connector main body and the handle inner member. Therefore, in this case, a resin material that can be adopted as each of resin materials of the connector main body and the handle inner member is limited to a resin material with which the potting material can be used (compatible with the potting material) (such as a polycarbonate (PC) resin and a polybutylene terephthalate (PBT) resin).

Incidentally, the above-mentioned resin materials (such as the polycarbonate (PC) resin and the polybutylene terephthalate (PBT) resin) are expensive as compared with resin materials such as a polyamide 6 (PA6) resin. Therefore, the door handle for a vehicle described in JP 2007-254995 A needs to adopt the expensive resin material as each of the resin materials of the connector main body and the handle inner member. Thus, a large amount of the expensive resin material is used, and hence an increase in cost is inevitable for the door handle.

The present invention has been made to solve the problem described above. A feature of the present invention resides in a door handle for a vehicle, including: a handle inner member made of a resin, which is adapted to be arranged on a vehicle inner side of a door of the vehicle; a handle outer member, which is assembled to a vehicle outer side of the handle inner member to form an accommodating portion between the handle outer member and the handle inner member; and a connector, which is provided to the handle inner member, in which: a connector main body made of a resin of the connector is formed as a member independent of the handle inner member, and is coupled integrally with the handle inner member; a connector terminal supported by the connector main body and an electronic component are connected in a component accommodating recessed portion, which is formed on one side in the connector main body and is communicated with the accommodating portion; and a connection portion between the connector terminal and the electronic component is protected by a potting material filled in the component accommodating recessed portion (door handle for a vehicle, including the above-mentioned handle inner member, handle outer member, connector main body, component accommodating recessed portion, connector terminal, electronic component, and potting material).

In the above-mentioned door handle for a vehicle of the present invention, by filling the potting material (silicone-based embedding resin) in the component accommodating recessed portion formed on the one side in the connector main body, the connection portion between the connector terminal and the electronic component can be protected. Therefore, the potting material can be set/placed so as not to adhere to the handle inner member. Accordingly, although an expensive resin material with which the potting material may be used (for example, a polycarbonate (PC) resin or a polybutylene terephthalate (PBT) resin) needs to be adopted for the connector main body, an inexpensive resin material (for example, a polyamide 6 (PA6) resin) may be adopted for the handle inner member.

Therefore, in the door handle for a vehicle of the present invention, the expensive resin material with which the potting material may be used is adopted (used) only for the connector main body. Consequently, as compared with a case where the expensive resin material with which the potting material may be used is adopted (used) for the connector main body and the handle inner member, the amount of use of the expensive resin material can be reduced. As a result, the door handle may be reduced in cost.

When implementing the present invention described above, the handle inner member may have formed therein a supporting hole, into which the connector main body is insertable, and which supports the connector main body; and the door handle for a vehicle may further include: a stopper configured to regulate an amount of insertion of the connector main body into the supporting hole; and an engagement claw configured to connect the handle inner member and the connector main body to each other under a state in which the amount of insertion of the connector main body is regulated by the stopper. In this case, the connector main body and the handle inner member may be connected without using assembly tools such as a nut and a screw. As a result, cost may be reduced owing to the reduction of the number of components.

In this case, the door handle for a vehicle may further include a cylindrical guiding portion provided in the supporting hole of the handle inner member, the cylindrical guiding portion exhibiting a cylindrical shape for guiding the insertion of the connector main body. In this case, ease of assembly of the connector main body to the handle inner member may be satisfactorily provided/improved. Further, in this case, a vehicle inner-side opening of the cylindrical guiding portion may be set to be located inside of the vehicle with respect to an insertion hole of a door outer panel of the door. In this case, water can be appropriately prevented from entering the cylindrical guiding portion. Furthermore, in this case, the door handle for a vehicle may further include a projection formed on a vehicle inner-side end portion of the cylindrical guiding portion, the projection being capable of coming into sliding contact with an outer circumferential surface of the connector main body. In this case, clattering of the connector main body assembled to the handle inner member inside the cylindrical guiding portion can be prevented.

Further, in the above-mentioned cases, the door handle for a vehicle may further include a retaining portion formed on the handle outer member, which is configured to prevent removal of the connector main body from the handle inner member. In this case, the removal of the connector main body from the handle inner member may be prevented through, for example, effective use of a rib for reinforcement which is provided in the handle outer member as the retaining portion.

DESCRIPTION OF EMBODIMENT

Figure 1:
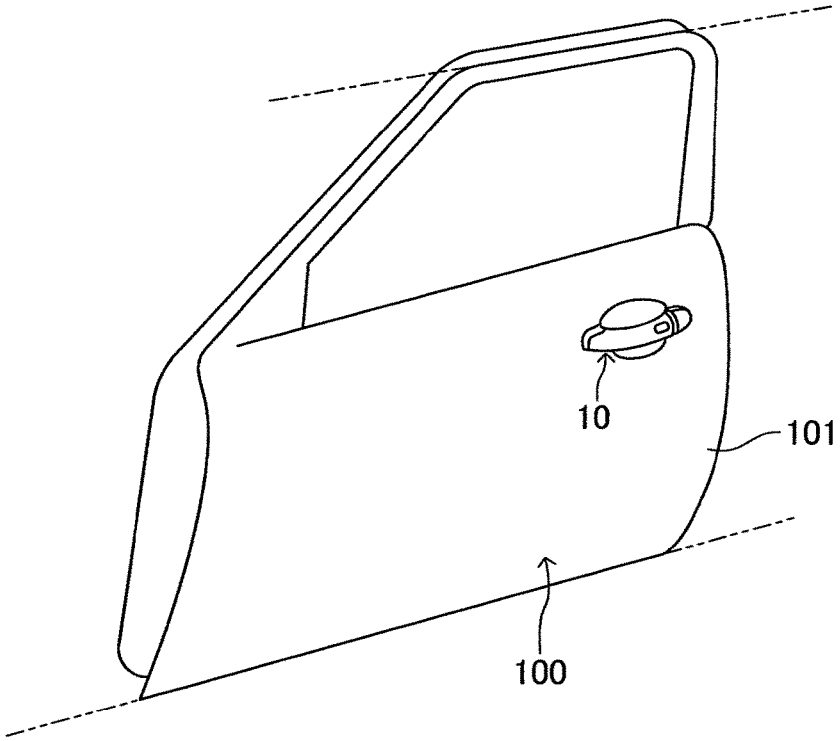
FIG. 1 is a perspective view for illustrating a door for a vehicle, which includes a door handle for a vehicle according to one embodiment of the present invention.
Figure 2:
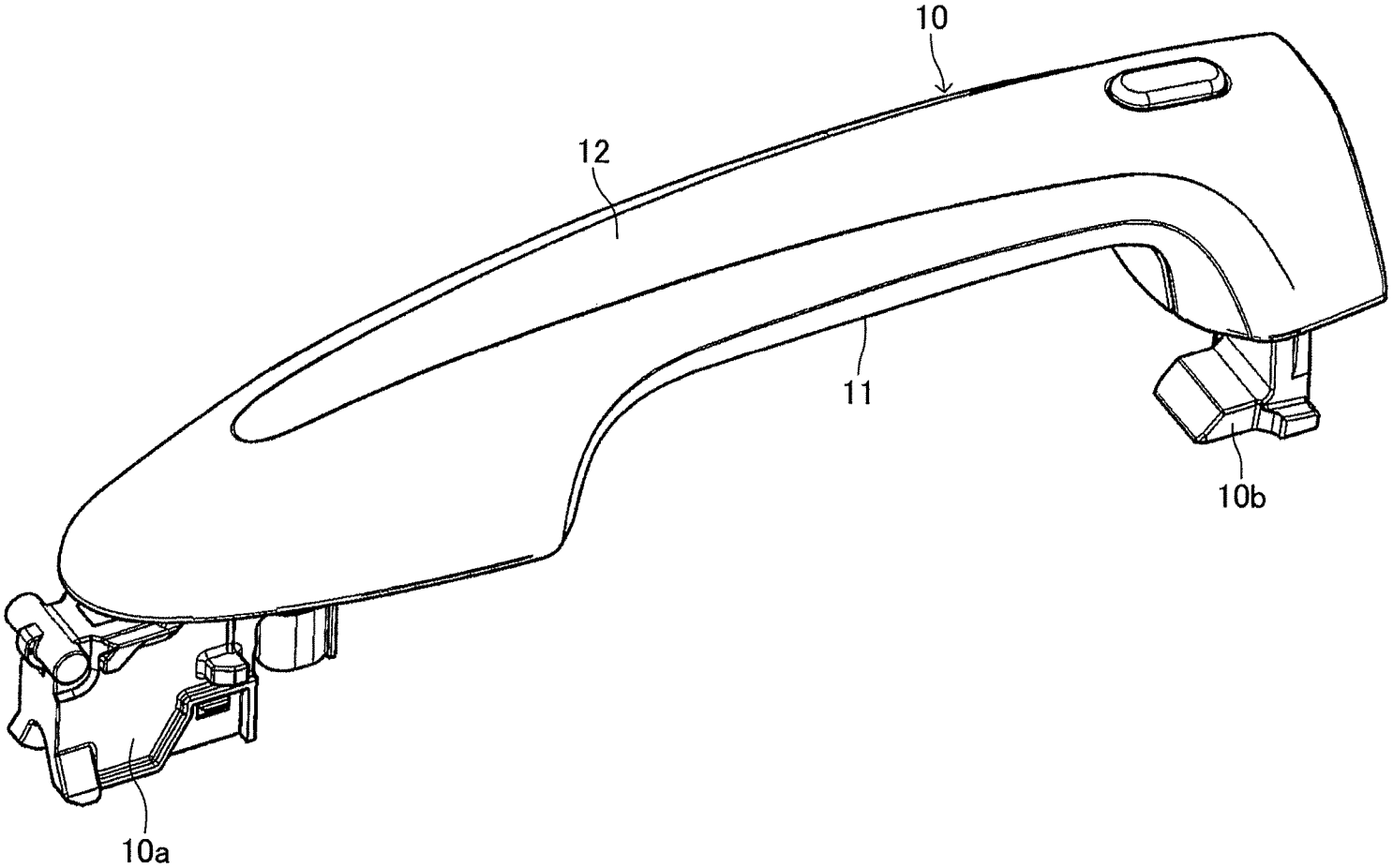
FIG. 2 is an enlarged perspective view of the door handle illustrated in FIG. 1.
Figure 3:
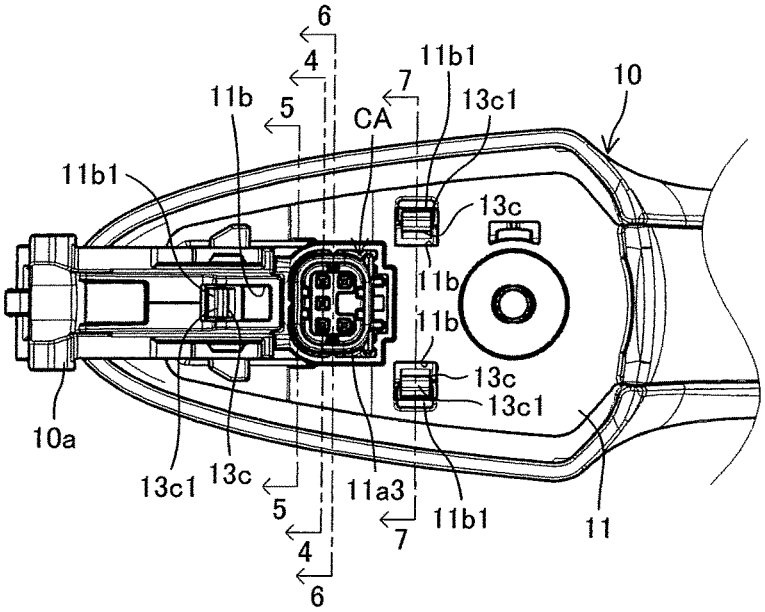
FIG. 3 is a view of a vehicle front-side portion of the door handle illustrated in FIG. 2 when viewed from a vehicle inner side (handle inner member side).

An embodiment of the present invention will be described referring to the drawings. FIG. 1 to FIG. 9 are illustrations of a door handle for a vehicle according to one embodiment of the present invention. A door handle 10 of this embodiment is, as illustrated in FIG. 1, assembled to a door 100 mounted to a front left side of a vehicle through use of a base member (not shown) as is well known. The door handle 10 is a grip-type door outer handle assembled in an approximately horizontal state to the base member so as to be swingable in a vehicle inside-and-outside direction (vehicle width direction), and is assembled to the base member provided inside the door 100 in a state of interposing a door outer panel 101 of the door 100 (in a state of being arranged on an outer side of the door outer panel 101 so as to partially pass through an insertion hole 101*a* formed in the door outer panel 101 (see the virtual line of FIG. 6)).

Further, the door handle 10 is assembled swingably (turnably) to the base member at a turning connection portion 10*a* provided to a vehicle front-side end portion as is well-known, and is connected to a door opening and closing mechanism (not shown) at an engagement portion 10*b* provided to a vehicle rear-side end portion as is well-known. The door handle 10 is configured such that a middle portion thereof is gripped with a hand to be tilted in a vehicle outside direction by a required amount so as to enable an opening operation of the door opening and closing mechanism (not shown).

The door handle 10 includes a handle inner member 11 made of a resin arranged on a vehicle inner side, a handle outer member 12 made of a resin assembled to a vehicle outer side of the handle inner member 11 to form an accommodating portion Ro between the handle outer member 12 and the handle inner member 11, and a handle-side connector CA provided to the handle inner member 11. The handle-side connector CA can be joined to and separated away from a door-side connector (now shown) as is well-known, and includes a connector main body 13 made of a resin and a plurality of connector terminals 14. In the accommodating portion Ro, an electronic component such as a transmitting antenna (not shown) is accommodated as is well-known.

The handle inner member 11 includes a stepped supporting hole 11*a* and three insertion holes 11*b*. The supporting hole 11*a* supports the connector main body 13, and includes a receiving portion 11*a*1 on a vehicle outer-side end portion and five linear projections 11*a*2 on a vehicle inner-side end portion. Further, the supporting hole 11*a* includes a cylindrical guiding portion 11*a*3 (small-diameter hole portion of the supporting hole 11*a*) for guiding insertion of the connector main body 13.

The cylindrical guiding portion 11*a*3 exhibits a cylindrical shape and has a length that is set so that a vehicle inner-side opening is located inside of the vehicle (arranged inside of the vehicle) with respect to the insertion hole 101*a* (see the virtual line of FIG. 6) formed in the door outer panel 101 of the door 100. Each of the insertion holes 11*b* is formed into a rectangular shape and includes an engagement portion 11*b*1 formed on a vehicle inner-side opening portion thereof (more specifically, a portion corresponding to one side of the rectangular opening).

Figure 5:
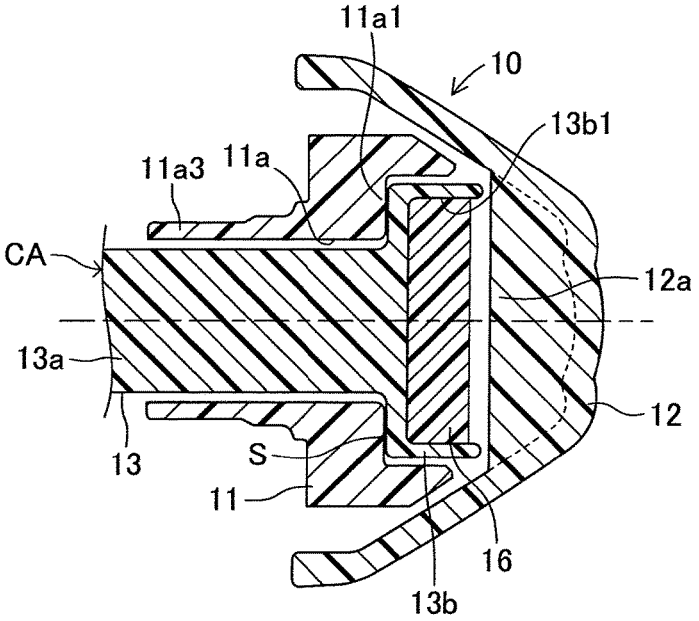
FIG. 5 is an enlarged sectional view taken along the line 5-5 of FIG. 3.
Figure 6:
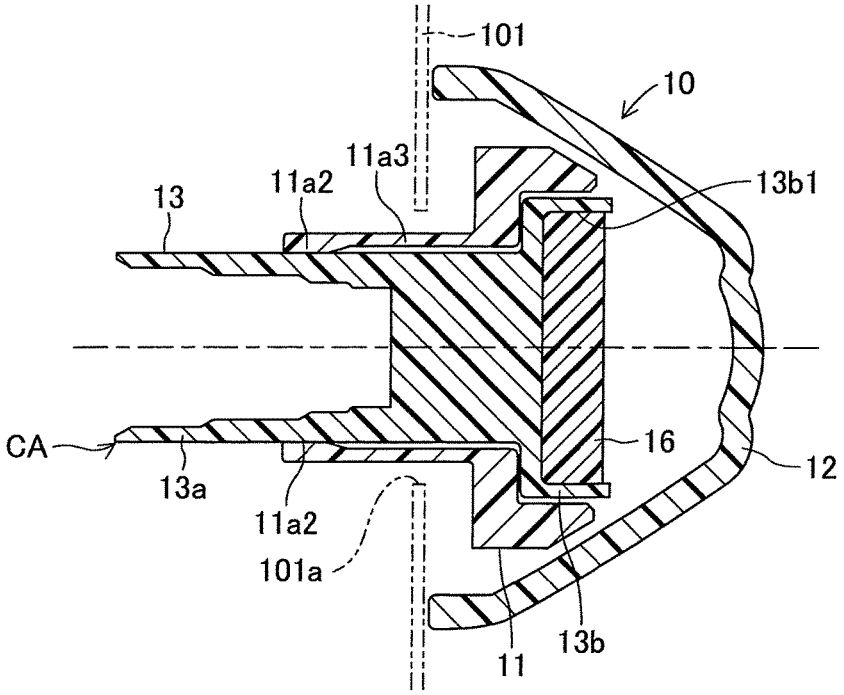
FIG. 6 is an enlarged sectional view taken along the line 6-6 of FIG. 3.

The handle outer member 12 is assembled integrally with the handle inner member 11 through use of appropriate connection means (for example, a connection screw (not shown)) so as to cover a vehicle outer side of the handle inner member 11. The handle outer member 12 includes a plurality of ribs formed on the inner side (vehicle inner side). One rib 12*a* thereof is arranged in a state of being close to the vehicle outer side of the connector CA, as illustrated in FIG. 5. Therefore, the rib 12*a* illustrated in FIG. 5 also functions as a retaining portion for preventing removal of the connector main body 13 from the handle inner member 11.

The connector main body 13 is formed as a member independent of the handle inner member 11, and includes a cylindrical leg portion 13*a* to be inserted into the supporting hole 11*a* of the handle inner member 11, a head portion 13*b* to be joined to the receiving portion 11*a*1 of the handle inner member 11, and connection arms 13*c* to be respectively inserted into the insertion holes 11*b* of the handle inner member 11. The leg portion 13*a* is configured to be able to come into sliding contact with each of the linear projections 11*a*2 of the handle inner member 11 on an outer circumferential surface thereof.

The head portion 13*b* constructs a stopper S together with the receiving portion 11*a*1. The stopper S regulates the amount of insertion of the connector main body 13 into the supporting hole 11*a*. Further, on a vehicle outer side (one side) of the head portion 13*b*, a component accommodating recessed portion 13*b*1 which is communicated with the accommodating portion Ro is formed. In the component accommodating recessed portion 13*b*1, the connector terminals 14 supported by the connector main body 13 and an electronic component 15 (for example, a substrate) are connected so as to be electrically conductive. A connection portion between the connector terminals 14 and the electronic component 15 is protected by a potting material 16 filled in the component accommodating recessed portion 13*b*1. The potting material 16 itself is a well-known silicone-based embedding resin.

Figure 7:
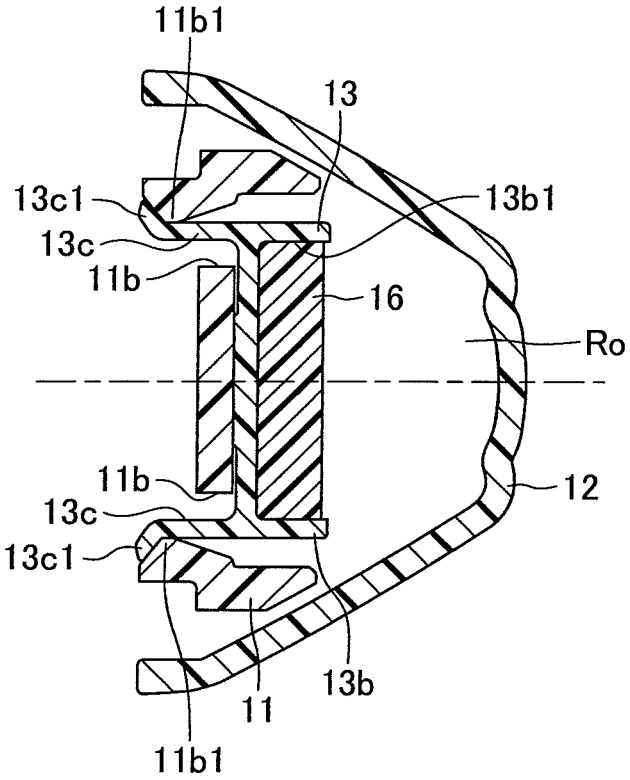
FIG. 7 is an enlarged sectional view taken along the line 7-7 of FIG. 3.
Figure 8:
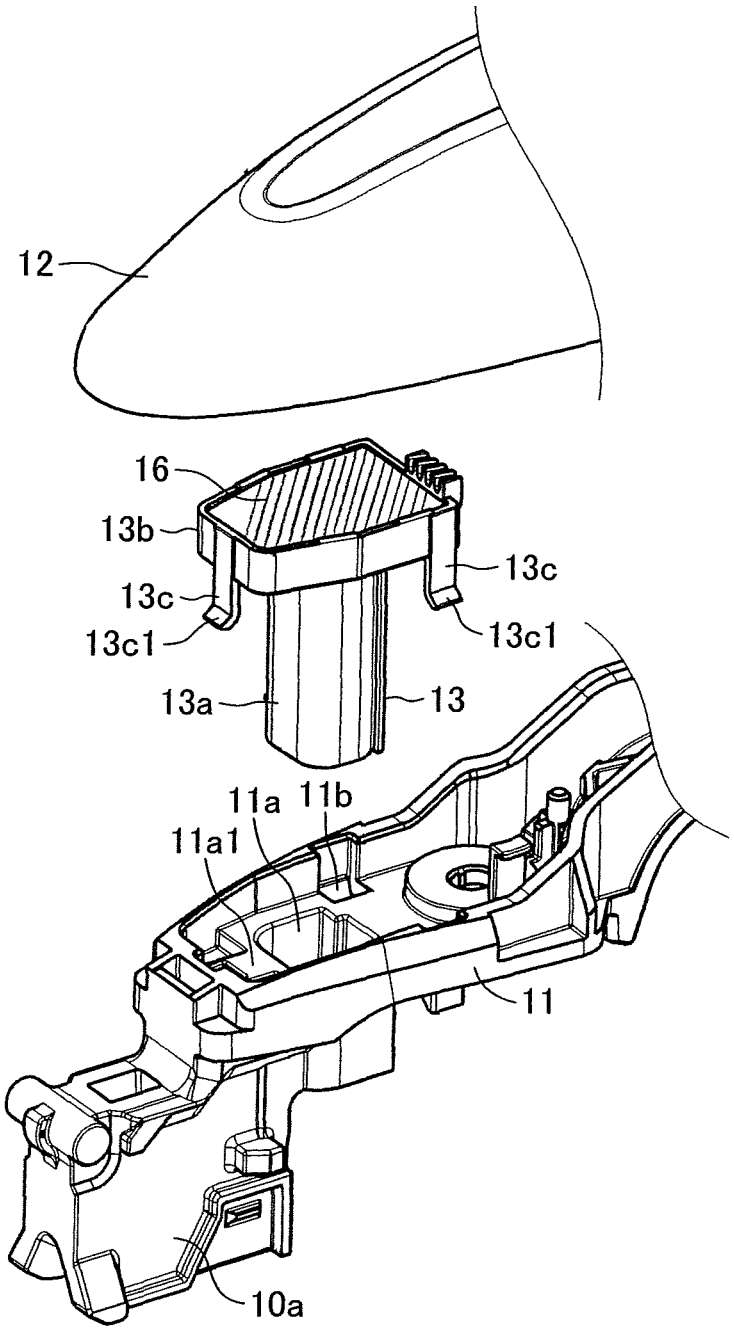
FIG. 8 is an exploded perspective view of the door handle illustrated in FIG. 3.
Figure 9:
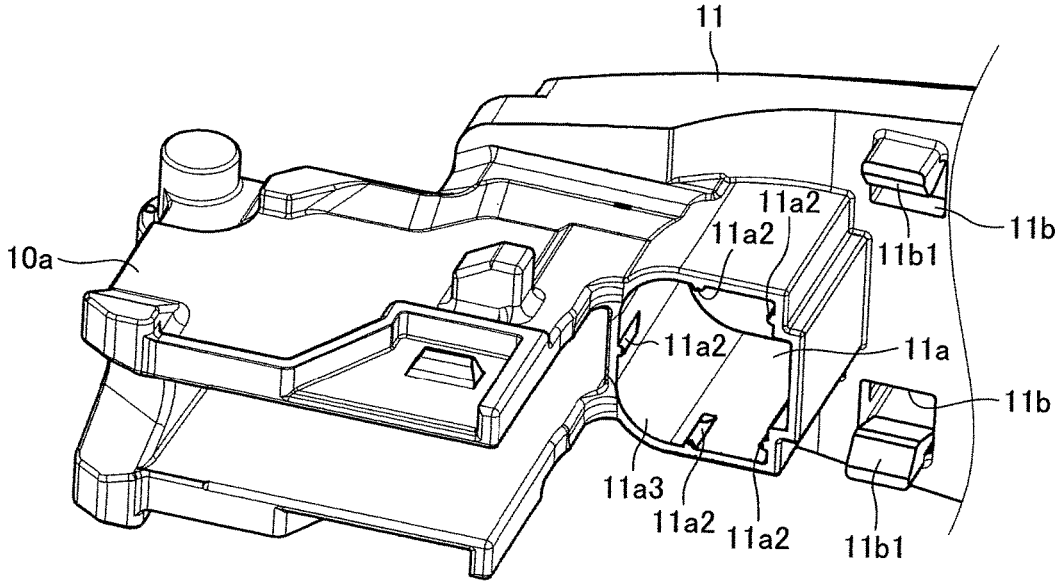
FIG. 9 is a perspective view of the handle inner member illustrated in FIG. 2 to FIG. 8.

Each of the connection arms 13*c* extends from the head portion 13*b* toward the leg portions 13*a*. At distal end portions of the connection arms 13*c*, engagement claws 13*c*1 (connection claws) that are elastically engageable with the engagement portions 11*b*1 of the handle inner member 11 are provided. Therefore, as illustrated in FIG. 7, under a state in which the amount of insertion of the connector main body 12 into the supporting hole 11*a* is regulated by the stopper S, the connector main body 13 is configured to be connected (coupled) integrally with the handle inner member 11 through use of the three connection arms 13*c* through elastic engagement of the engagement claws 13*c*1 of the connector main body 13 with the engagement portions 11*b*1 of the handle inner member 11.

Figure 4:
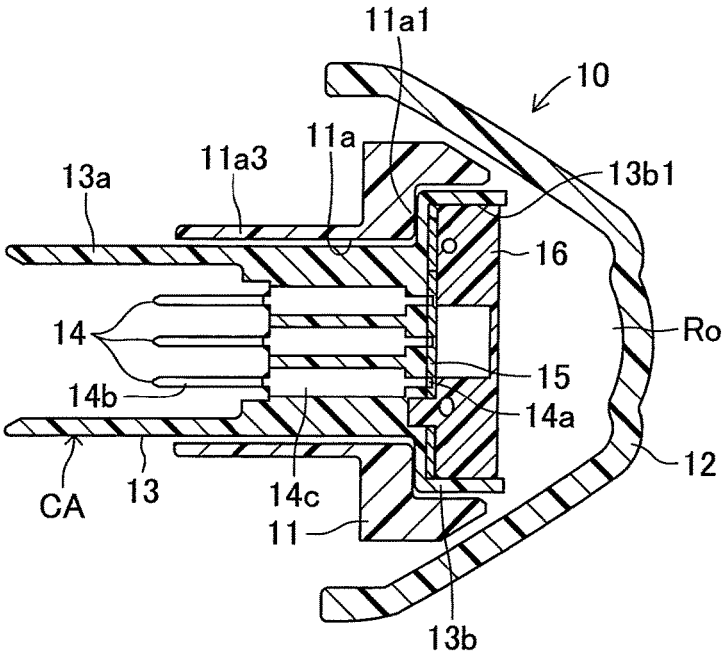
FIG. 4 is an enlarged sectional view taken along the line 4-4 of FIG. 3.

As illustrated in FIG. 4, each of the connector terminals 14 includes an intermediate portion 14*c* molded (integrally molded) into the connector main body 13 under a state in which one end portion 14*a* projects into the component accommodating recessed portion 13*b*1 of the connector main body 13 and another end portion 14*b* projects in the leg portion 13*a* of the connector main body 13, so that each of the connector terminals 14 is assembled into the connector main body 13 to be supported by the connector main body 13. The electronic component 15 is conductively connected to each of the connector terminals 14 and is also conductively connected to an electronic component such as a transmitting antenna (not shown) accommodated in the accommodating portion Ro. A connection portion between the electronic component 15 and the electronic component such as the transmitting antenna (not shown) is also protected by the potting material 16 filled in the component accommodating recessed portion 13*b*1.

In this embodiment configured as described above, by/owing to filling the potting material 16 (silicone-based embedding resin) in the component accommodating recessed portion 13*b*1 formed on one side in the connector main body 13, the connection portion between the connector terminals 14 and the electronic component 15 can be protected. In this manner, the potting material 16 can be set so as not to adhere to the handle inner member 11. Therefore, although an expensive resin material (such as a polycarbonate (PC) resin and a polybutylene terephthalate (PBT) resin) with which the potting material 16 can be used needs to be adopted for the connector main body 13, an inexpensive resin material (such as a polyamide 6 (PA6) resin) can be adopted for the handle inner member 11.

Therefore, in the door handle 10 of this embodiment, the expensive resin material with which the potting material 16 can be used is adopted (used) only for the connector main body 13. Accordingly, as compared with a case where the expensive resin material with which the potting material can be used is adopted (used) for the connector main body (13) and the handle inner member (11), the amount of use of the expensive resin material can be reduced to reduce the cost of the door handle 10.

Moreover, in this embodiment, the stopper S configured to regulate the amount of insertion of the connector main body 13 into the supporting hole 11*a* formed in the handle inner member 11 is formed in a coupling portion between the connector main body 13 and the handle inner member 11. In addition, the engagement claws 13*c*1 to be elastically engaged with the engagement portions 11*b*1 provided to the handle inner member 11 under a state in which the amount of insertion is regulated by the stopper S are provided to the connector main body 13. Therefore, the connector main body 13 and the handle inner member 11 can be connected (coupled) to each other without using assembly tools such as a nut and a screw. Thus, the cost can be reduced by reducing the number of components.

Further, in this embodiment, the cylindrical guiding portion 11*a*3 exhibiting the cylindrical shape for guiding the insertion of the connector main body 13 is provided to the supporting hole 11*a* of the handle inner member 11. Therefore, ease of assembly of the connector main body 13 to the handle inner member 11 can be satisfactorily provided. Further, the vehicle inner-side opening of the cylindrical guiding portion 11*a*3 is set so as to be located inside of the vehicle with respect to the insertion hole 101*a* of the door outer panel 101. Therefore, water can be appropriately prevented from entering the cylindrical guiding portion 11*a*3.

Further, on the vehicle inner-side end portion of the cylindrical guiding portion 11*a*3, the linear projections 11*a*2 that can come into sliding contact with the outer circumferential surface of the connector main body 13 (outer circumferential surfaces of the leg portions 13*a*) are provided. Therefore, clattering of the connector main body 13 assembled to the handle inner member 11 inside the cylindrical guiding portion 11*a*3 can be prevented. It should be noted that a shape of each of the linear projections 11*a*2 may be appropriately set/designed. For example, a hemispherical (dot-like) projection may be used instead, to implement the present invention.

Further, in this embodiment, the rib 12*a* (retaining portion) for preventing the removal of the connector main body 13 from the handle inner member 11 is formed on the handle outer member 12. Therefore, the removal of the connector main body 13 from the handle inner member 11 can be prevented through effective use of the rib 12*a* for reinforcement formed on the handle outer member 12.

In the embodiment described above, the handle inner member 11 and the connector main body 13 are connected (coupled) integrally with each other through use of the connection arms 13*c* of the connector main body 13. However, the handle inner member 11 and the connector main body 13 may also be configured to be connected (coupled) integrally with each other through use of coupling means (such as a nut and a screw) other than the connection arms 13*c* to implement the present invention. Further, in the embodiment described above, the engagement portions 11*b*1 are provided to the handle inner member 11, and the connection arms 13*c* and the engagement claws 13*c*1 are provided to the connector main body 13. However, to implement the present invention, the connection arms (13*c*) and the engagement claws (13*c*1) may be provided to the handle inner member (11), and the engagement portions (11*b*1) may be provided to the connector main body (13). Further, to implement the present invention, the cylindrical guiding portion 11*a*3 and the linear projections 11*a*2 may be omitted, or even the rib 12*a* may be omitted.

In the embodiment described above, the present invention is carried out with the turning connection portion 10*a* formed on the vehicle front-side end portion of the door handle 10 and the engagement portion 10*b* formed on the vehicle rear-side end portion of the door handle 10 being provided to the handle inner member 11. However, the present invention may also be implemented with the turning connection portion 10*a* formed on the vehicle front-side end portion of the door handle 10 and the engagement portion 10*b* formed on the vehicle rear-side end portion of the door handle 10 being provided to the handle outer member 12.

Further, in the embodiment described above, the present invention is carried out with the door handle 10 for a vehicle according to the present invention being provided onto the door 100 mounted to the front left side of the vehicle. However, the door handle for a vehicle according to the present invention may be applied not only to a door mounted to a front right side of the vehicle but also to a door mounted to a rear right side or a rear left side of the vehicle in a similar manner or with appropriate changes. Further, the door handle for a vehicle according to the present invention may also be applied to a door mounted to a rear side of the vehicle (back door) in a similar manner or with appropriate changes.

The invention claimed is:

1. A door handle for a vehicle, comprising:

a handle inner member made of a resin, which is adapted to be arranged on a vehicle inner side of a door of the vehicle, the handle inner member including a supporting through hole extending through the handle inner member in a vehicle width direction;

a handle outer member, which is assembled to a vehicle outer side of the handle inner member to form an accommodating portion between the handle outer member and the handle inner member;

a connector main body made of a resin, which is formed as a member independent of the handle inner member and connected to the handle inner member, wherein the connector main body penetrates through the supporting through hole in the vehicle width direction and is supported by the supporting through hole;

a component accommodating recessed portion, which is formed in a vehicle outer side end portion of the connector main body to communicate with the accommodating portion, the handle inner member surrounding at least a portion of the connector main body in which the component accommodating recessed portion is formed;

a connector terminal, which is supported by the connector main body;

an electronic component, which is connected to the connector terminal; and a potting material, which is filled in the component accommodating recessed portion, for protecting a connection portion between the connector terminal and the electronic component, wherein the potting material is disposed in the accommodating portion between the handle outer member and the handle inner member, the door handle for a vehicle further comprises a stopper configured to regulate an amount of insertion of the connector main body into the supporting through hole;

the handle inner member includes an insertion through hole which extends through the handle inner member in the vehicle width direction; and the connector main body comprises:

a connection arm which is inserted into the insertion through hole from the vehicle outer side; and an engagement claw which is provided at a vehicle inner-side end portion of the connection arm and is configured to connect the handle inner member and the connector main body to each other by engaging with the handle inner member from the vehicle inner side under a state in which the amount of insertion of the connector main body is regulated by the stopper.

2. A door handle for a vehicle according to claim 1, further comprising a guiding portion provided in the supporting through hole of the handle inner member, the guiding portion exhibiting a tube shape for guiding the insertion of the connector main body.

3. A door handle for a vehicle according to claim 2, wherein a vehicle inner-side opening of the guiding portion is set so as to be located inside of the vehicle with respect to an insertion hole of a door outer panel of the door.

4. A door handle for a vehicle according to claim 2, further comprising a projection formed on a vehicle inner-side end portion of the guiding portion, the projection being capable of coming into sliding contact with an outer circumferential surface of the connector main body.

5. A door handle for a vehicle according to claim 1, further comprising a retaining portion formed on the handle outer member, the retaining portion being configured to prevent removal of the connector main body to the vehicle outer side from the handle inner member.

* * * * *